US005707205A

United States Patent [19]

Otsuka

[11] Patent Number: 5,707,205

[45] Date of Patent: Jan. 13, 1998

[54] FAN DEVICE

[75] Inventor: Shigeru Otsuka, Yonago, Japan

[73] Assignee: Matsushita Electric Industrial Co., Ltd., Japan

[21] Appl. No.: 707,716

[22] Filed: Sep. 4, 1996

[30] Foreign Application Priority Data

Jul. 4, 1996 [JP] Japan ..... 8-174042

[51] Int. Cl.[6] ..... F04D 29/66

[52] U.S. Cl. ..... 415/119; 415/208.5; 415/211.1; 415/214.1; 415/914; 416/247 R; 361/695

[58] Field of Search ..... 415/119, 186, 415/187, 208.3, 208.5, 211.1, 214.1, 914; 165/135; 257/721, 722; 361/695–697; 416/247 R

[56] References Cited

U.S. PATENT DOCUMENTS

| | | | |
|---|---|---|---|
| 2,628,018 | 2/1953 | Koch | 415/186 |
| 2,628,020 | 2/1953 | Koch . | |
| 3,574,480 | 4/1971 | Hoepfner | 415/211.1 |
| 5,288,203 | 2/1994 | Thomas | 415/214.1 |
| 5,292,088 | 3/1994 | Lemont . | |
| 5,393,197 | 2/1995 | Lemont et al. | 415/211.1 |
| 5,407,324 | 4/1995 | Starnes, Jr. et al. | 415/208.5 |

FOREIGN PATENT DOCUMENTS

| | | | |
|---|---|---|---|
| 0123712 | 9/1979 | Japan | 415/119 |
| 92/22459 | 12/1992 | WIPO . | |

*Primary Examiner*—Christopher Verdier
*Attorney, Agent, or Firm*—Parkhurst, Wendel & Burr, L.L.P.

[57] ABSTRACT

An air moving device for improving P-Q characteristics and noise by suppressing the production of vortices. An annular wall spaced from blade tips, is formed of a plurality of annular plates and spacers with a slit defined between adjacent annular plates. The width of each slit is set to satisfy the formula $W \leqq (\nu \cdot R_{ec}/v)$ where $\nu$ is the kinematic viscosity of air, v is the peripheral speed of the blade tips, W is the width of the slits and $R_{ec}$ is the critical Reynold's number. Thus, as a fan is rotated, air is drawn in a laminar flow through the slits to the inner periphery of the annular wall. Thereby, it is possible to suppress the separation of air flow on the suction side of blade surfaces and the production of vortices, thus improving the air moving state.

5 Claims, 8 Drawing Sheets

FAN DEVICE

FIELD OF THE INVENTION

The present invention relates to an air moving device for cooling purposes used in electronic apparatuses and instruments and so on.

BACKGROUND OF THE INVENTION

With miniturization or downsizing and electronic design changes of apparatuses and instruments, high density packaging of electronic circuits has become popular. With this trend, the heat generating density of electronic apparatuses and instruments increases, so that axial flow type or diagonal flow type air moving devices are used for cooling.

A conventional air moving device, as shown in FIG. 9, has an annular wall 2 spaced from the blade tips of an axial flow fan 1. In the air moving state with the motor 3 energized, the axial flow fan 1 is rotated around the axis of the shaft 4, producing an air flow 5 moving from the inlet side to the outlet side.

Further, U.S. Pat. Nos. 2,628,020 and 5,292,088 disclose an arrangement wherein the annular wall is replaced by a plurality of rings stacked to define spaces between adjacent rings, the spaces serving as an air flow inlet to draw air from the outer periphery of the fan.

DISCLOSURE OF THE INVENTION

In the air moving state shown in FIG. 9, the speed of the air flow increases on the suction side of the blade tips, and at the trailing edges of the blades where the velocity is converted into pressure energy, a low energy region is created due to the influence of interblade secondary flow. In this region, the loss is high and separation of flow tends to occur, with the air flow separating from the blade surfaces, and vortices are created in the separated region, increasing turbulent flow noise to aggravate the noise level and static pressure-quantity of flow characteristic (hereinafter referred to as the P-Q characteristic).

This phenomenon is frequently observed particularly when the outlet flow side is subjected to a flow resistance (i.e. system impedance), in which case the leakage vortices at the blade tips increase, until the fan is forced to stay in a stalling condition.

However, the air moving device disclosed in U.S. Pat. No. 2,628,020 is so designed that air introduced from the outer periphery flows obliquely rearward so as to allow air flowing in through the air flow inlet to meet the fan delivery air. However, this is not intended to suppress the production of vortices, contributing little to improvement of the P-Q characteristic and reduction in noise.

Further, the air moving device disclosed in U.S. Pat. No. 5,292,088 is so designed that air introduced from the air flow inlet between rings forms vortices around the outer periphery of the fan for increasing the flow rate, or the vortices present around the outer periphery of the fan are utilized for increasing the flow rate by enhancing the flow of vortices.

Contrary to this, according to the present invention that is different in technical concept from said U.S. Pat. No. 5,292,088 which utilizes vortices for increasing the flow rate, the production of vortices is suppressed thereby to improve the P-Q characteristic and quietness.

An air moving device according to the present invention is characterized in that an annular wall is constructed such that it is spaced from the blade tips of the fan, said annular wall being formed at its portions opposed to the blade tips with slits which establish communication between the inner and outer peripheral portions of the annular wall, the width of said slits being set to satisfy the formula $$W \leqq (\nu \cdot R_{ec}/v)$$

where ν is the kinematic viscosity of air; v is the peripheral speed of the blade tips; W is the width of the slits; and $R_{ec}$ is the critical Reynolds' number, whereby as the fan is rotated, air is drawn in a laminar flow through said slits to the inner periphery of the annular wall.

According to this arrangement, the annular wall is constructed such that it is separated from the blade tips, said annular wall being formed at its portions opposed to the blade tips with slits which establish communication between the inner and outer peripheral portions of the annular wall, and the width of said slits is set such that as the fan is rotated, air is drawn in a laminar flow through said slits to the inner periphery of the annular wall, suppressing the aforementioned separation of air flow and the aforementioned production of vortices on the suction side of the blade surface, thereby making it possible to improve the air moving state and to improve the P-Q characteristic and reduce noise as compared with the conventional air moving device.

The air moving device is preferably characterized in that a plurality of annular plates are laminated axially to define spaces W defined between adjacent annular plates, thereby forming a slitted annular wall.

Spacers which define the slits, may be inclined with respect to the axis of the fan.

Alternatively, the spacers may be curved by using a line segment which is straight or curved or of a combined shape with respect to the diametrical direction of the fan.

Preferably, the air moving device is characterized in that the number of radial spacers is a prime number which is 3 or above.

The air moving device may be characterized in that the fan is an axial flow fan or a diagonal flow fan.

DESCRIPTION OF EMBODIMENTS

Figure 1A:
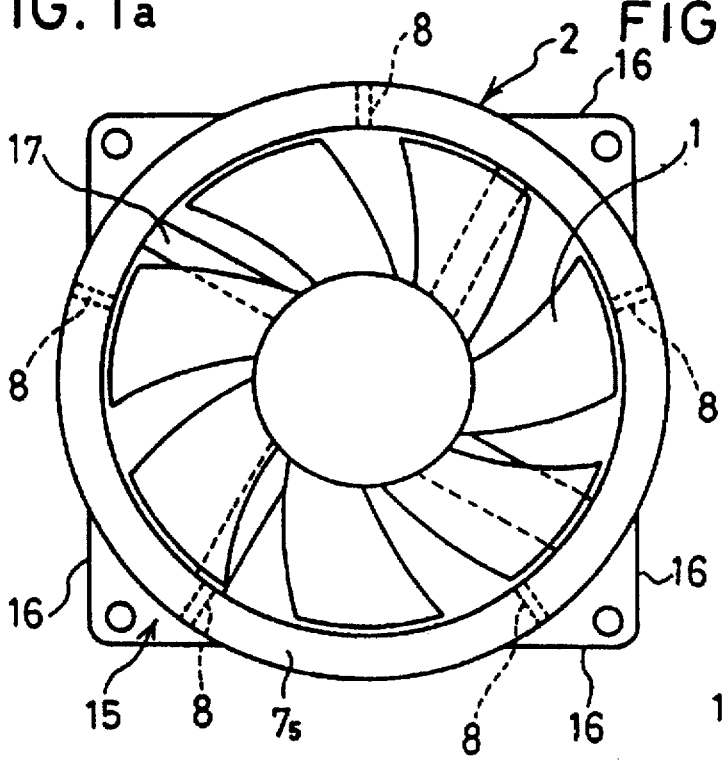
FIG. 1*a* is a front view.
Figure 1B:
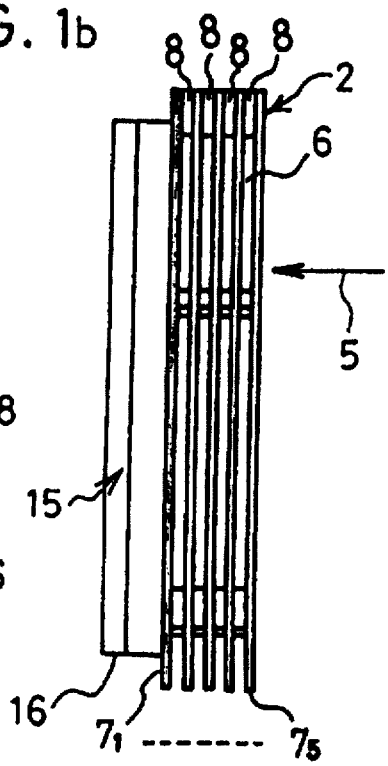
FIG. 1*b* is a side view and FIG. 1*c* is a sectional view of a first embodiment axial flow type air moving device according to an of the invention.

Embodiments of the invention will now be described with reference to FIGS. 1 through 8 and FIG. 10.

FIGS. 1 through 4 show a first embodiment.

The air moving device has slits 6 formed in an annular wall surrounding an axial flow fan 1. Stated concretely, annular disks or plates $7_1$, $7_2$, $7_3$, $7_4$, $7_5$ are laminated with spacers 8 held between adjacent annular plates, with slits 6 each formed between adjacent annular plates.

Figure 1C:
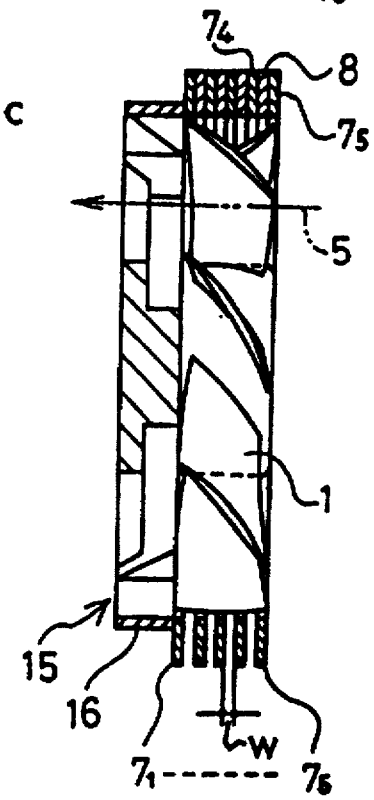
Figure 2:
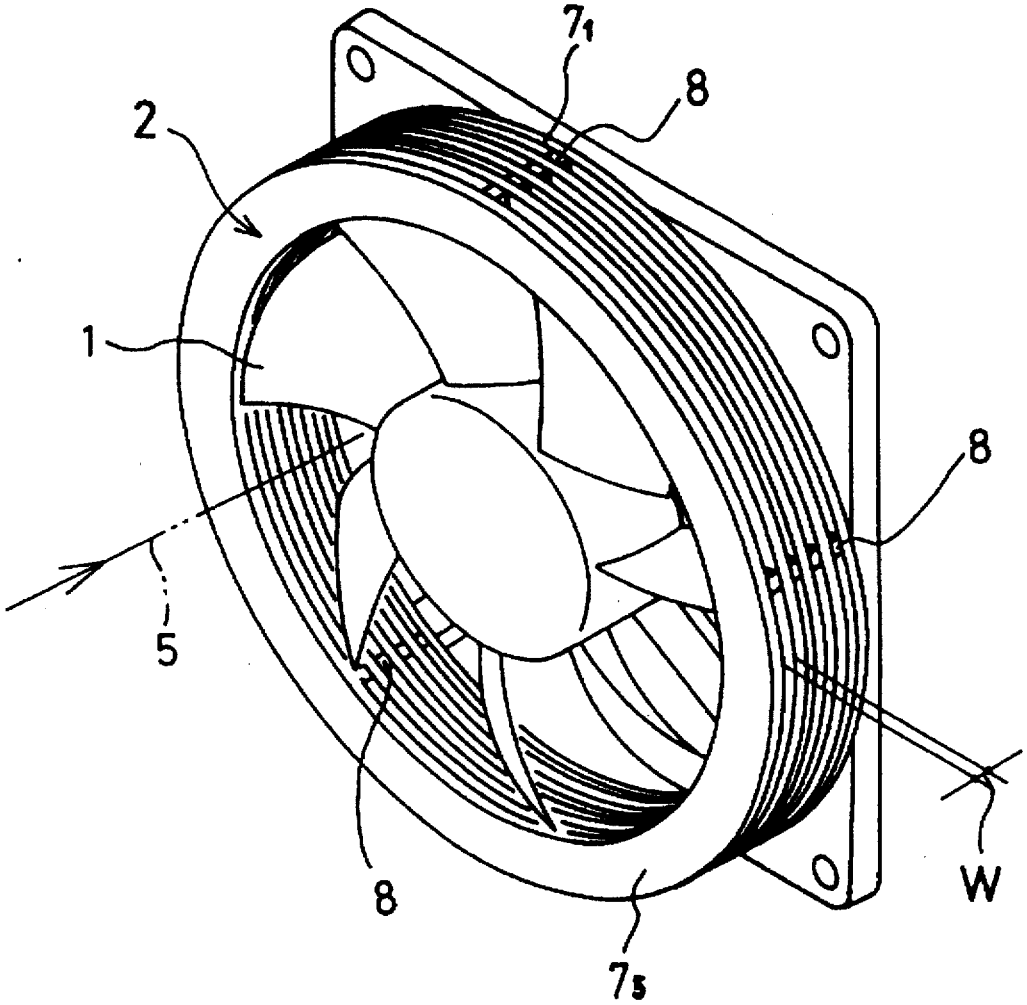
FIG. 2 is an external perspective view of the first embodiment.

As shown in FIG. 1*c*, the width of the laminated annular plates $7_1$–$7_5$ is set equal to or substantially equal to the axial width of the axial flow fan 1. Further, the width w of each slit 6 is set as follows.

Figure 3:
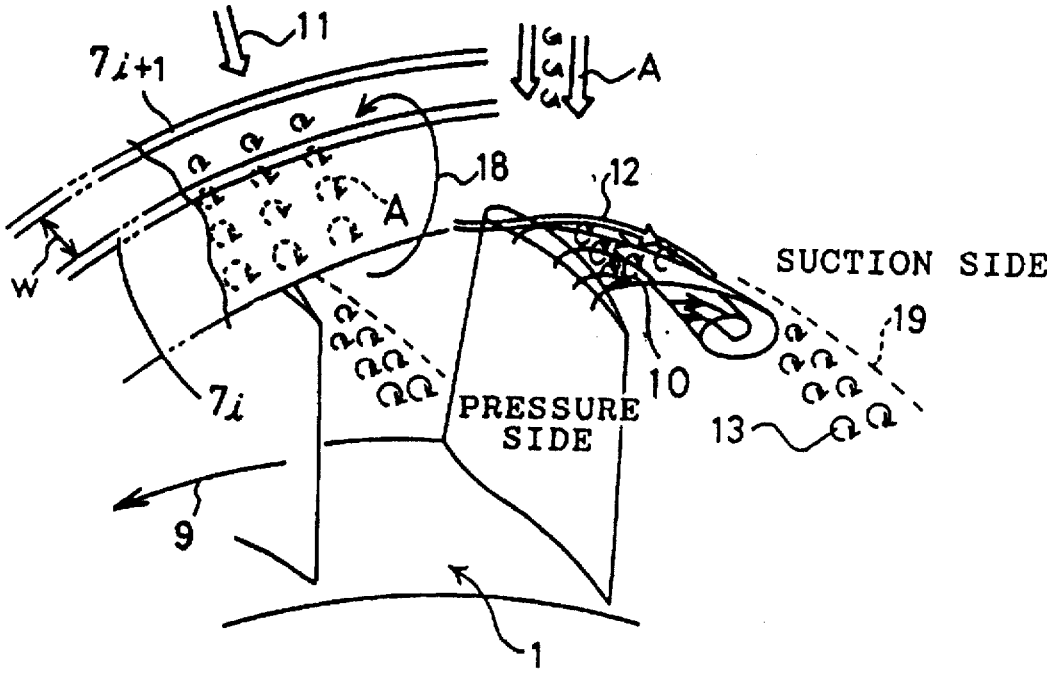
FIG. 3 is a view for explaining the operating principle of the prior art.

FIG. 3 schematically shows a case where the width W of the slit 6 is greater than necessary. In this case, leakage vortices 10 are produced to move from the pressure side to the suction side at the blade tips as the axial flow fan 1 is rotated in the direction of an arrow 9. Further, as the axial flow fan 1 is rotated, there is produced an inflow of ambient air 11 moving from each slit 6 toward the inner side. In the case where the width W of the slit 6 is greater than necessary, the air flow A through each slit 6 is turbulent, which passes through the clearance between the blade tips and the inner peripheral surface of the annular wall 2 to become a leakage flow 12 which enters the suction side, where the air flow separates from the blade surfaces. The numeral 19 denotes the suction surface separation boundary line, and vortices 13 are produced in the separating region, aggravating the P-Q characteristic and increasing noise. In this case, a disk circulation 18 is also created in which air flow which once flows in through one slit flows out through the next slit, leading to further aggravation of the P-Q characteristic and further increase in noise.

Figure 4:
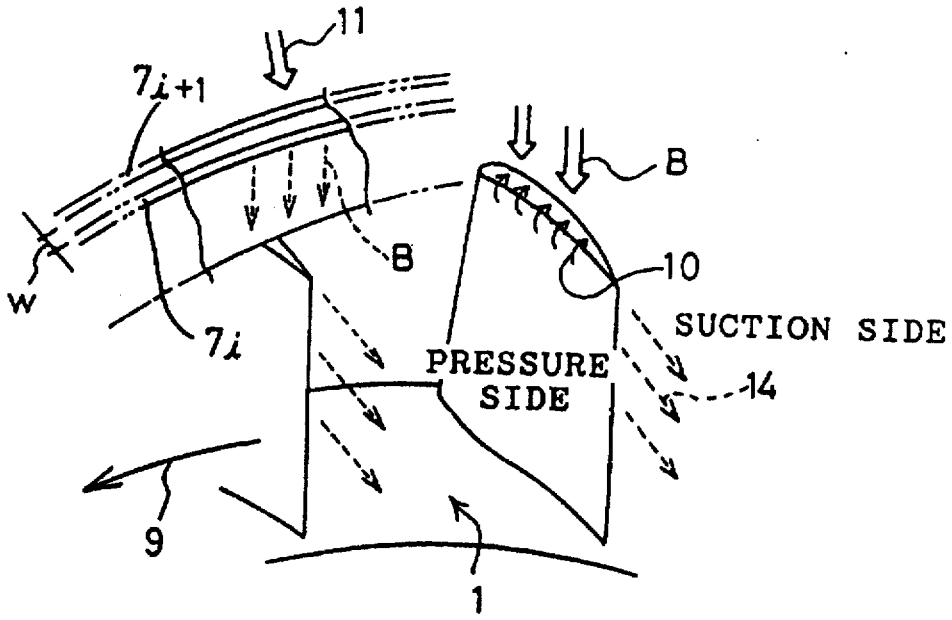
FIG. 4 is a view for explaining the operating principle of the present invention.

In contrast, FIG. 4 shows a case where the width W of the slit 6 is properly set. In the case where the width W of the slit 6 has been properly set such that the air flow B through each slit 6 toward the inside becomes laminar, the leakage vortices 10 flowing to the blade tips from the pressure side to the suction side are suppressed more than in the case shown in FIG. 3 to the extent that there is no separation of air flow at the suction surface. Numeral 14 denotes a suction surface non-separation streamline, which improves the P-Q characteristic and reduces noise.

The value of the width W of the slit 6 which ensures that the air flow moving in through the slit 6 is laminar will now be described in detail.

The dimensionless Reynolds' number having to do with the determination of whether an air flow is laminar or turbulent is:

$$R_e=(v\cdot w)/\nu$$

In the formula, ν is the kinematic viscosity of air (15.6 $mm^2$ / s at 20° C.); v is the peripheral speed of the blade tips; and W is the width of the slit. Therefore, $$W=(R_e\cdot\nu)/v$$

Let $R_{ec}$ be the critical Reynolds' number at which a change from laminar to turbulent flow takes place, and with $R_{ec}$ taken to be about 2000 (precisely, 2320, which is an approximate value for a flow in a pipe), the width W of the slit is computed below.

Suppose that the diameter d of the axial flow fan of a common axial flow type fan motor having a housing size of 92×92 mm is about 86.5 mm and the speed of rotation N is 3000 rpm. The peripheral speed v of the blade tips of this axial flow fan is:

$$\begin{aligned} v &= (\pi\cdot d\cdot N)/(1000\times 60)\\ &= (\pi\cdot 86.5\cdot 3000)/(1000\times 60)\\ &= 13.58\ \text{m/s}. \end{aligned}$$

Substitution of these values into the above formula gives $$\begin{aligned} W &= (2000\times 15.6)/(13.58\times 1000)\\ &= 2.297\times 10^{-3}\ \text{m}\\ &= 2.297\ \text{mm}. \end{aligned}$$

Therefore, it is seen that in the case of a common axial flow type fan motor having a housing size of 92×92 mm, if the spacers 8 are produced to set the width of the slits to "W ≦2.297 mm", then the air flow moving in through the slits 6 toward the inside is laminar.

It goes without saying that if the width W of the slits is too small, the slits present a resistance to inflow of air, making it impossible to expect the aforesaid improved P-Q characteristic or reduced noise.

It is seen that forming the slits 6 in the annular wall 2 in this manner and properly setting the width W of the slits improves the P-Q characteristic and reduces noise.

Figure 10:
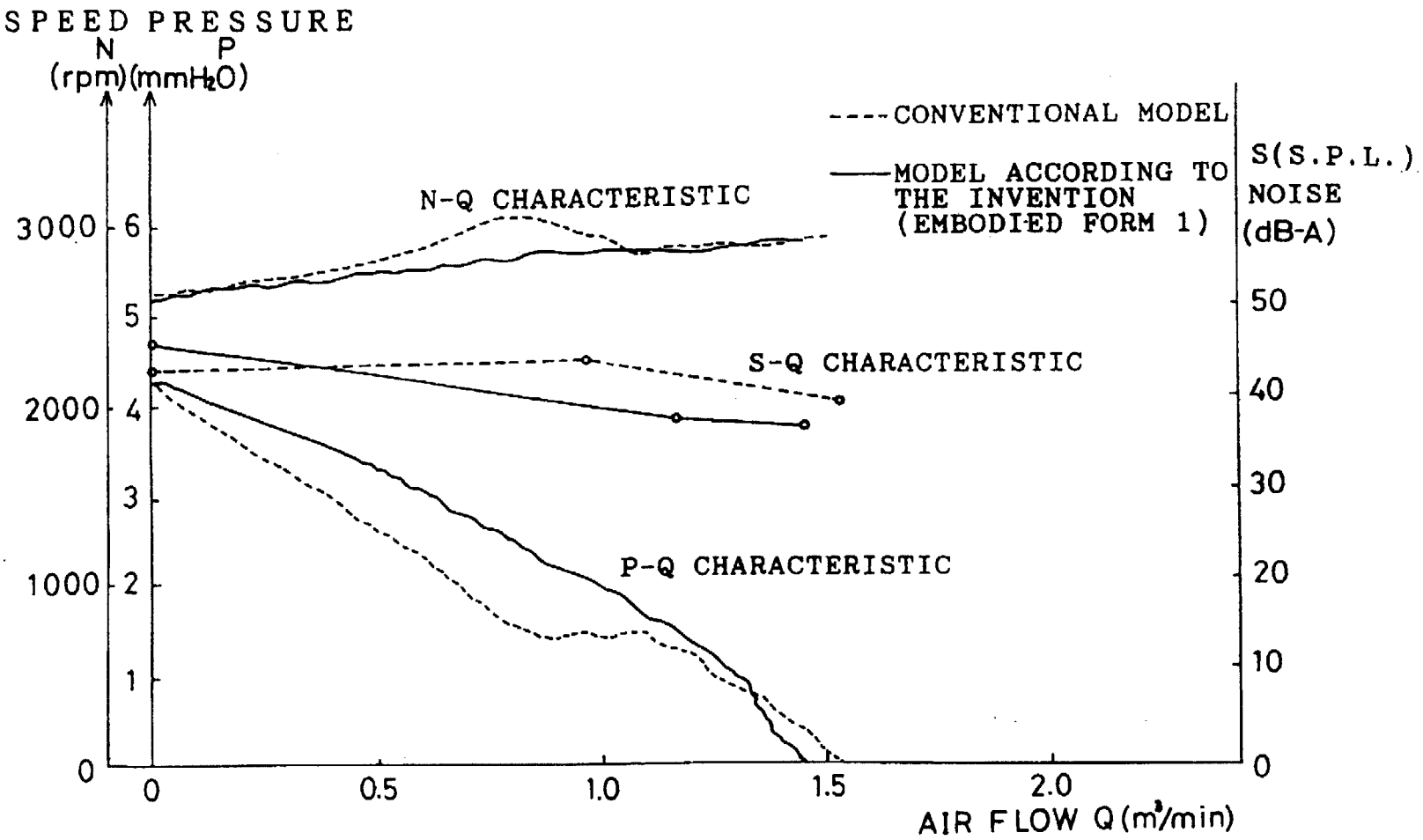
FIG. 10 is a graph showing measured characteristics of a conventional axial flow type air moving device and the first embodiment.

FIG. 10 is a graph comparing a conventional model which is a common axial flow type air moving device having a housing size of 92×92 mm and the embodied model according to the first embodiment, as to measured values obtained when the models are subjected to a back pressure during operation in practical use. The broken lines refer to the conventional model and the solid lines to the model of the first embodiment for the N (rpm)—Q characteristic, S (noise)—Q characteristic, and P-Q characteristic, where Q stands for quantity of air flow and S for sound pressure level. It is obvious from this comparison that the embodied model has a great advantage.

Figure 5:
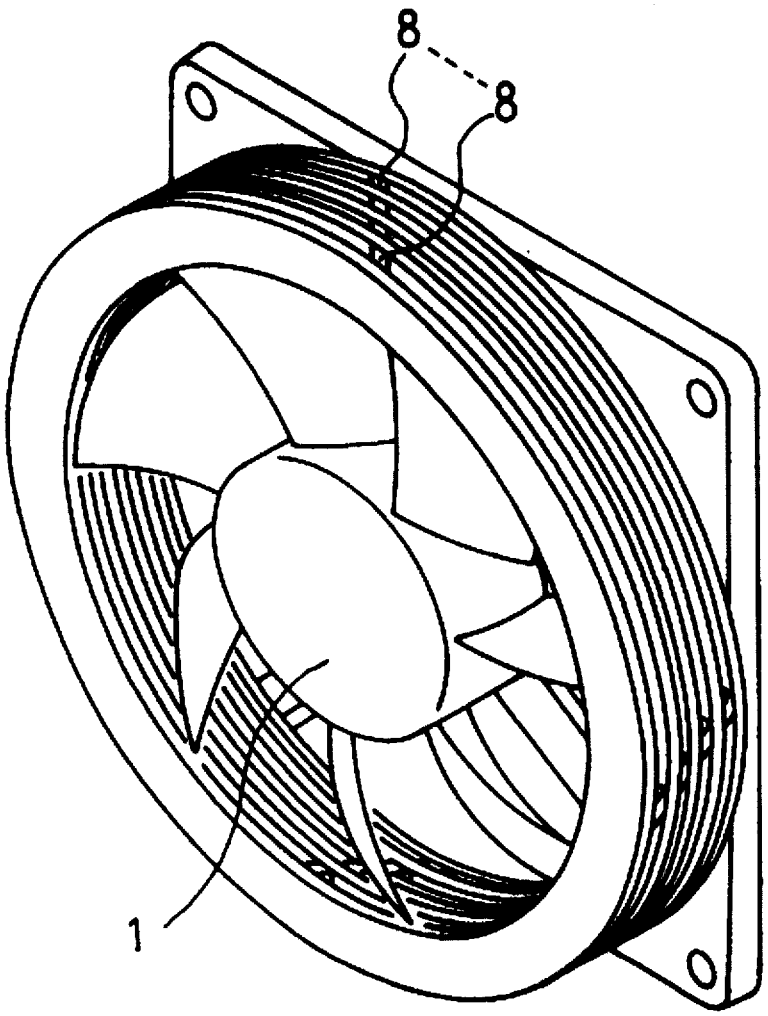
FIG. 5 is an external perspective view of an axial flow air moving device according to a second embodiment of the invention.

FIG. 5 shows an a second embodiment. In the first embodiment, the spacers 8 for holding the annular plates $7_1$–$7_5$ spaced apart from each other are disposed in the same circumferential position in the upper layer (upstream side of the flow) and the lower layer (downstream side of the flow). The second embodiment differs from the first embodiment in that, as shown in FIG. 5, the spacers 8 in the upper and lower layers are shifted in the direction reverse to the inclination of the blade tips. Properly setting the width W of the slits is the same.

With this arrangement, the spacers can be made to be out of synchronism with the air passing position of the blade tips, whereby noise can be further reduced.

Figure 6A:
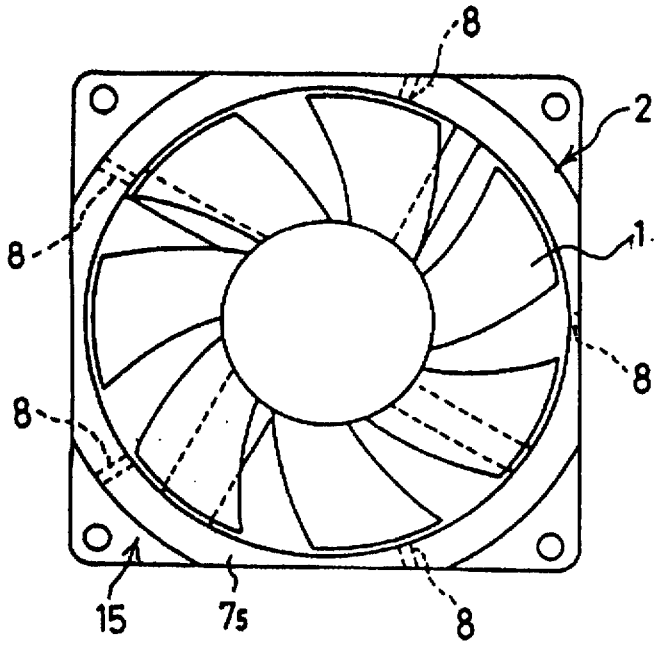
FIG. 6*a* is a front view and FIG. 6*b* is a side view of an axial flow air moving device according to a third embodiment of the invention.
Figure 6B:
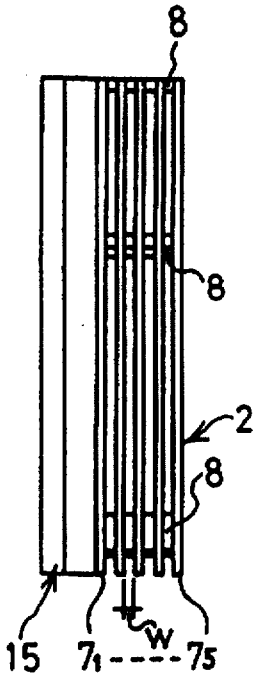

FIGS. 6*a* and 6*b* illustrate a third embodiment.

The third embodiment is a modification of the first embodiment. The annular wall 2 of the first embodiment has an outer shape that projects further outward from the rectangular casing body 15 in the vicinity of the middle of each of the upper, lower, right and left edges 18. However, in the third embodiment, the annular plates $7_1$–$7_5$ constituting the annular wall 2 have their portions coresponding to the middle regions of the upper, lower, right and left edges 16 shaped flush with the casing body 15. The rest of the arrangement is the same as in the embodying form 1. In addition, in FIG. 6*b*, the axial flow fan 1 is omitted from the illustration.

With the arrangement thus made, although the function of drawing laminar air flow through the slits 6 is a little lower than that of the embodying form 1, the P-Q characteristic is improved and noise is reduced as compared with the conventional axial flow fan. Further, another merit is that the installation space required in practice is the same as in the conventional model.

Figure 7A:
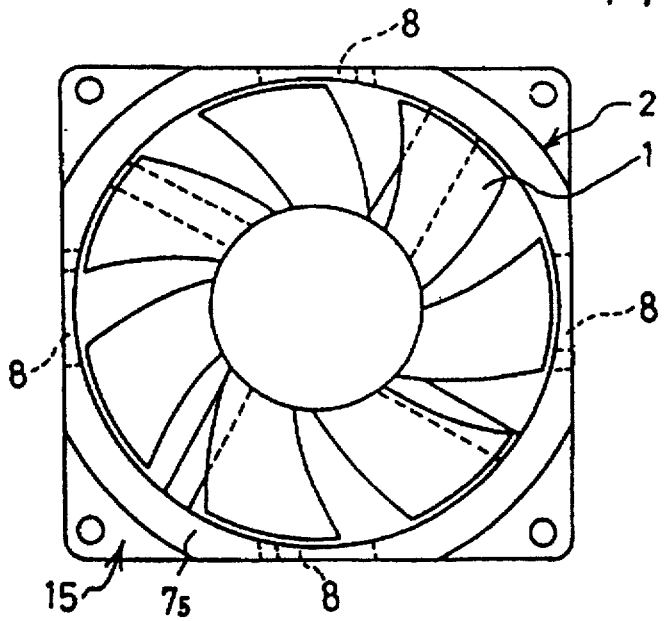
FIG. 7*a* is a front view and FIG. 7*b* a side view of an axial flow air moving device according to a fourth embodiment of the invention.
Figure 7B:
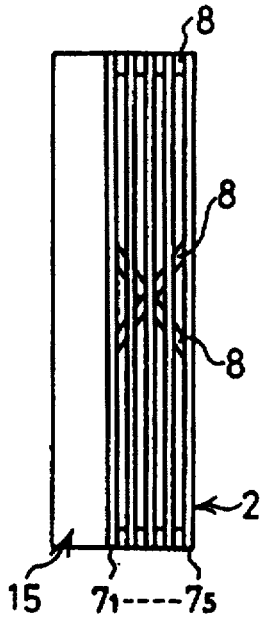

FIGS. 7*a* and 7*b* show a fourth embodiment. The fourth embodiment is a modification of the second embodiment, and as in the third embodiment, the annular plates $7_1$–$7_5$ constituting the annular wall 2 have their portions corresponding to the middle regions of the upper, lower, right and left edges 16 shaped flush with the casing body 15. The rest of the arrangement is the same as in the second embodiment. In addition, in FIG. 7*b*, the axial flow fan is omitted from the illustration, and it is well seen that the spacers 8 in the upper and lower layers are inclined from the upper to the lower layer as they are shifted in the direction reverse to the inclination of the blade tips.

With the arrangement thus made, although the function of drawing laminar air flow through the slits 6 is a little lower than that of the second embodiment, the P-Q characteristic is improved and noise is reduced as compared with the conventional axial flow fan. Further, another merit is that the installation space required in practice is the same as in the conventional model.

Further, since the air flowing in through the outer peripheries of the slits is allowed to flow in at the tip surfaces of the fan blades in a couterattack manner, an additional slight improvement in the P-Q characteristic can be expected.

Figure 8A:
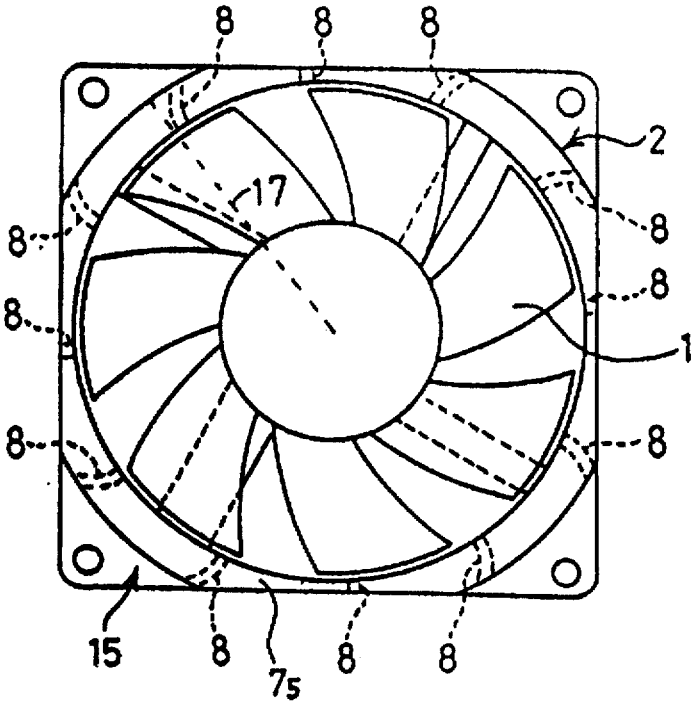
FIG. 8*a* is a front view and FIG. 8*b* a side view of an axial flow air moving device according to a fifth embodiment of the invention.
Figure 8B:
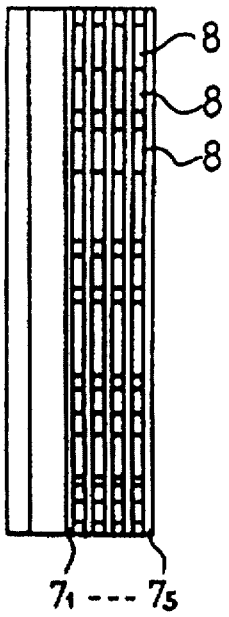
Figure 9:
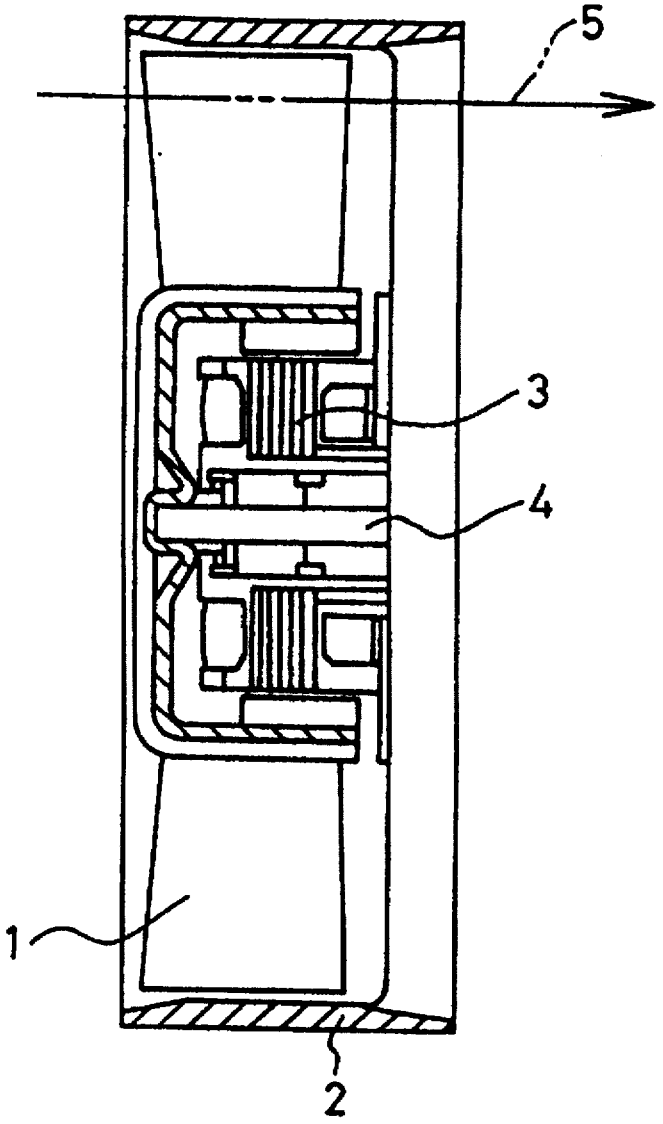
FIG. 9 PRIOR ART
FIG. 9 is a sectional view of conventional axial flow type air moving device.

FIGS. 8*a* and 8*b* show a fifth embodiment. The fifth embodiment is a modification of the third embodiment shown in FIGS. 6*a* and 6*b* and the only difference from the embodying form 3 is that the spacers 8 are curved in the diametrical direction of the axial flow fan 1. In particular, each of the spacers 8 increasingly curves away from a radial line 17 extending from an innermost to an outermost periphery of each spacer 8. In addition, in FIG. 8*b*, the axial flow fan is omitted from the illustration.

With this arrangement, the air flowing in through the slits is subjected to a contraction effect in advance, making it possible to expect a further improvement in the P-Q characteristic. As for the curving of the spacers, they are curved by using a line segment which is straight or curved or of a combined shape with respect to the diametrical direction of the axial flow fan.

Further, curving the spacers 8 diametrically of the axial flow fan 1 as in this fifth embodiment may also be employed in the first through fourth embodiments.

In each of the above embodiments, if an arrangement is employed in which the number of radial spacers is a prime number which is 3 or above and the number of fan blades and the number of spokes 17 are not synchronized with said prime number, then a resonant phenomenon (in this case, air resonance) can be avoided, contributing greatly to noise reduction.

The form of each embodiment above has been described as an axial flow fan, but the invention is likewise applicable to a diagonal flow fan.

What is claimed is:

1. An air moving device, comprising:

a fan having blades which terminate at blade tips; and an annular wall spaced from the blade tips of the fan, said annular wall having slits that establish communication between inner and outer peripheral portions of the annular wall, the width of said slits being set to satisfy the formula $$W \leqq (\nu \cdot R_{ec}/v),$$

where ν is the kinematic viscosity of air, v is the peripheral speed of the blade tips, W is the width of the slits, and $R_{ec}$ is the critical Reynolds' number, whereby as the fan is rotated, air is drawn in a laminar flow through the slits to the inner periphery of the annular wall.

2. An air moving device as set forth in claim 1, wherein the annular wall is defined by a plurality of annular plates that are laminated along the axial direction of the fan to define spaces between adjacent annular plates.

3. An air moving device as set forth in claim 2, further comprising spacers provided between adjacent annular plates, said spacers being positioned along a direction that is inclined with respect to the axis of the fan.

4. An air moving device as set forth in claim 2, further comprising spacers provided between adjacent annular plates, each said spacer being increasingly curved with respect to a respective radial line extending from an innermost periphery of the spacer to an outermost periphery of a respective spacer.

5. An air moving device as set forth in claim 2, further comprising spacers provided between adjacent annular plates, said spacers being grouped together in plural sets that are spaced apart from each other along a circumferential direction of the annular plates, wherein the air moving device comprises a prime number of said sets which is not less than 3.

* * * * *